US008322704B1

(12) United States Patent
Blair et al.

(10) Patent No.: US 8,322,704 B1
(45) Date of Patent: Dec. 4, 2012

(54) SYSTEM AND DEVICE FOR FEEDING SHEETS OF MEDIA

(75) Inventors: Brian Allen Blair, Richmond, KY (US); Niko Jay Murrell, Lexington, KY (US); Jason Lee Rowe, Richmond, KY (US); Jeffrey Lawrence Tonges, Versailles, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/198,946

(22) Filed: Aug. 5, 2011

(51) Int. Cl.
*B65H 3/06* (2006.01)
*B65H 1/00* (2006.01)

(52) U.S. Cl. ..... 271/117; 271/171

(58) Field of Classification Search ..... 271/117, 271/118, 171
See application file for complete search history.

(56) References Cited

U.S. PATENT DOCUMENTS

| | | | | |
|---|---|---|---|---|
| 4,098,501 | A * | 7/1978 | Tani et al. | 271/117 |
| 5,294,104 | A * | 3/1994 | Nishigaki | 271/117 |
| 5,975,517 | A * | 11/1999 | Lim | 271/117 |
| 2007/0052153 | A1* | 3/2007 | DeVore et al. | 271/117 |
| 2007/0158901 | A1* | 7/2007 | Lee | 271/171 |
| 2010/0194022 | A1* | 8/2010 | Kawaguchi | 270/58.08 |
| 2011/0298174 | A1* | 12/2011 | Wang | 271/226 |

* cited by examiner

*Primary Examiner* — David H Bollinger
(74) *Attorney, Agent, or Firm* — John Victor Pezdek

(57) ABSTRACT

A system that reduces pick skew and improves reliability of a picking mechanism by moving the pick arm to multiple locations across a media feed direction based on media size such that media pick forces are substantially balanced about the centerline of a media sheet to be picked. The system includes a pick arm slidably mounted on a shaft, at least one pick roller mounted to an end of the pick arm for contacting a top sheet of a stack of media sheets and driven to pick media sheets one at a time therefrom, and a pick arm translation mechanism for moving the pick arm along the shaft based on media sheet size of the media stack such that the at least one pick roller remains substantially evenly positioned about a centerline of a media sheet in a media feed direction.

21 Claims, 10 Drawing Sheets

SYSTEM AND DEVICE FOR FEEDING SHEETS OF MEDIA

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present disclosure relates generally to a device and a system for feeding a media sheet from a stack of media sheets and, more particularly, to a device and a system for changing the position of a pick arm across a media path based on the size of media sheets in a media stack.

2. Description of the Related Art

A typical image forming apparatus such as an electrophotographic printer or an inkjet printer, for example, includes a media sheet feed system having a media picking mechanism for picking a media sheet and a media tray for holding a stack of media sheets, such as paper, on which to print images. One type of picking mechanism utilizes an auto compensating pick module (ACM). The ACM includes at least one pick roller and a gear train that transmits both a rotational force and a downward force to the pick roller.

In reference edge type systems, the ACM is typically positioned to feed a wide range of media sizes without requiring adjustments. For example, the ACM may be positioned across the media feed direction such that there are always two pick roller tires touching any supported media from the narrowest to the widest. If two tires are not placed on a supported media, misfeeds and paper jams may result during a sheet pick operation.

However, when the ACM is positioned to allow feeding of a narrowest supported media, pick reliability of a widest supported media is compromised. This is because the ACM is positioned offset from the centerline of the widest supported media in order to support the narrowest supported media. When pick forces are applied to a wide media sheet, the offset location of the pick forces creates a moment on the media sheet that skews the media when picked by the at least one pick roller. The skew in the media must then be removed by a downstream media alignment system before image transfer. Skewing the media during a pick operation further creates an opportunity for paper jams and increases the amount of energy that must be used on the media sheet by the alignment system.

Based upon the foregoing, there is a need to effectively reduce pick skew and improve reliability of a picking mechanism in reference edge type systems by substantially eliminating the moment placed on the sheet by the pick roller tires during a media sheet picking operation. Further, there is also a need to increase the number of different media sizes supported by a media tray in an image forming apparatus without compromising pick reliability of the widest supported media.

SUMMARY

Embodiments of the present disclosure provide for the reduced pick skew and improved reliability of a picking mechanism by moving the pick arm to multiple locations across the media feed direction based on media size such that media pick forces are substantially balanced about the centerline of a media sheet being picked.

In an example embodiment, the present disclosure relates to a pick device comprising a pick arm slidably mounted on a shaft, at least one pick roller mounted to an end of the pick arm for contacting a top of a stack of sheets of media and driven to pick media sheets one at a time therefrom, and a pick arm translation mechanism for moving the pick arm along the shaft based on media sheet size of the media stack such that the at least one pick roller remains substantially evenly positioned about a centerline of a media sheet in a media feed direction.

In another example embodiment, the present disclosure relates to a media feed system comprising a pick mechanism and a pick arm translation mechanism. The pick mechanism includes a pick arm and at least one pick roller. The pick arm is slidably mounted on a shaft and the at least one pick roller is mounted to an end of the pick arm for contacting a top of a stack of sheets of media and is driven to pick media sheets one at a time therefrom. The pick arm translation mechanism moves the pick arm into a plurality of positions along the shaft based on media sheet size of the media stack such that the at least one pick roller remains substantially evenly positioned about a centerline of a media sheet in a media feed direction.

In another example embodiment, the present disclosure relates to a media feed system comprising a housing, a media tray for holding a media stack, a pick mechanism, and a pick arm translation mechanism. The media tray is insertable within the housing and includes a media restraint member adjustable within the media tray for setting media sheet size. The pick mechanism has a pick arm and at least one pick roller, and is disposed above the media tray when the media tray is inserted within the housing. The pick arm is slidably mounted on a shaft, the at least one pick roller is mounted to an end of the pick arm, and the pick arm is movable along the shaft between a first position and a second position. The pick arm translation mechanism is engageable with the media tray for selectively moving the pick arm from the first position to the second position along the shaft during insertion of the media tray within the housing, based on a position of the media restraint member within the media tray.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
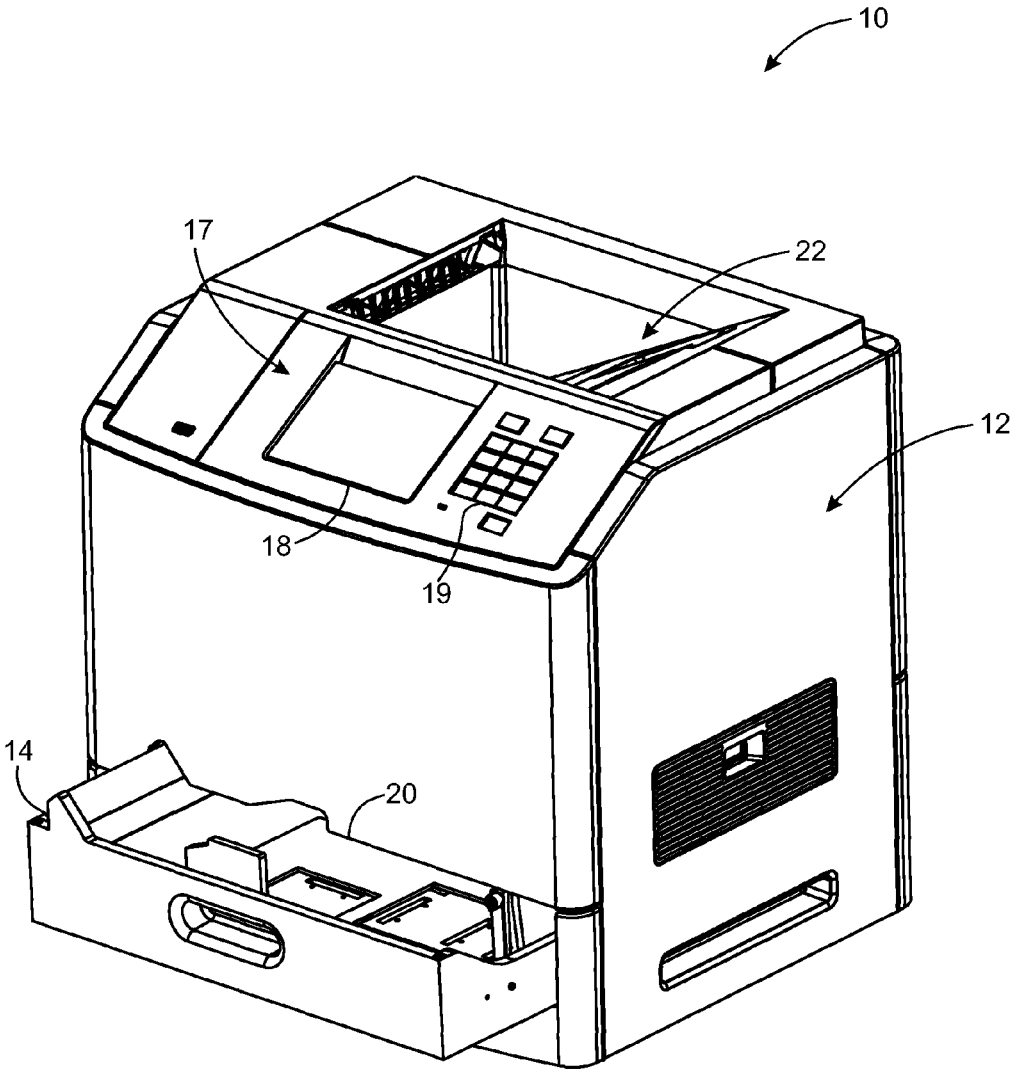
FIG. 1 is a perspective view of one example embodiment of an imaging apparatus.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

Furthermore, and as described in subsequent paragraphs, the specific mechanical configurations illustrated in the drawings are intended to exemplify embodiments of the invention and that other alternative mechanical configurations are possible.

Reference will now be made in detail to the example embodiments, as illustrated in the accompanying drawings. Whenever possible, the same reference numerals will be used throughout the drawings to refer to the same or like parts.

FIG. 1 illustrates a perspective view of an imaging apparatus 10. Imaging apparatus 10, which may be a standalone imaging device, includes a housing 12 having an input media tray 14 for supporting sheets of media, such as, but not limited to, paper, card stock film, such as transparencies, or printer labels. The input media tray 14 may be inserted into or removed from the imaging apparatus 10 through an opening 20. Imaging apparatus 10 may also include a media output area 22 positioned along an upper part of imaging apparatus 10 in which printed media sheets are placed.

Figure 2:
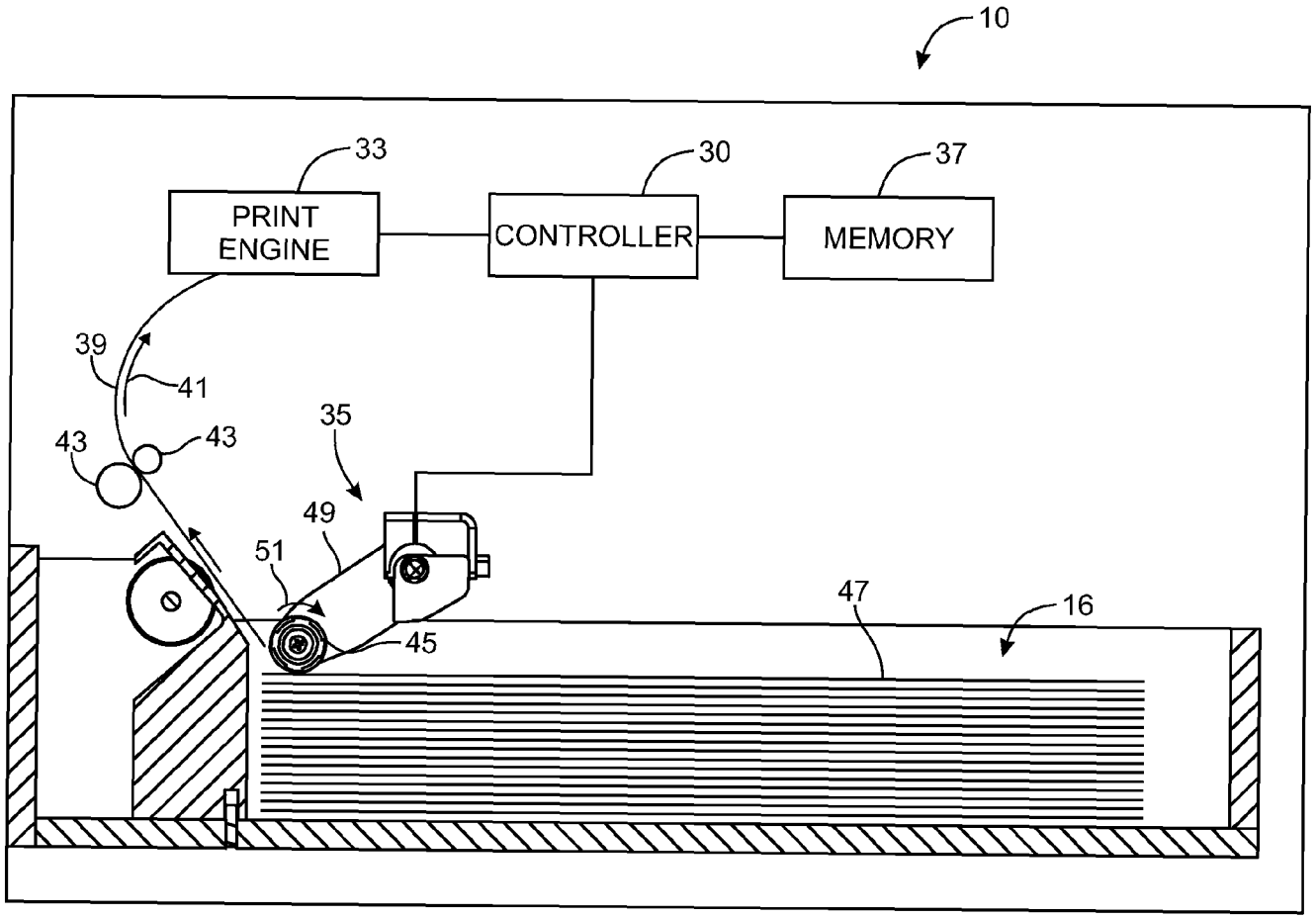
FIG. 2 is a side section view depicting components of the imaging apparatus in FIG. 1.

FIG. 2 is an illustrative embodiment depicting at least some of the components of imaging apparatus 10. Imaging apparatus 10 may include a controller 30 communicatively coupled to a print engine 33 and a sheet feed system 35. Controller 30 may include a processor unit (not shown) and an associated memory 37, and may be formed as one or more Application Specific Integrated Circuits (ASICs). Memory 37 may be any memory device convenient for use with controller 30.

Controller 30 may communicate with print engine 33. Controller 30 may serve to process print data and to operate print engine 33 during printing of an image onto a sheet of media. Print engine 33 may include any of a variety of different types of printing mechanisms including dye-sublimation, dot-matrix, ink jet or laser printing.

Imaging apparatus 10 may include a user interface 17 (FIG. 1), such as a graphical user interface, for receiving user input concerning operations performed or to be performed by imaging apparatus 10, and for providing to the user information concerning the same. The user interface 17 may include firmware maintained in memory 37 within housing 12 which may be performed by controller 30 or other processing element. In an example embodiment, the user interface 17 may include a display panel 18, which may be a touch screen display in which user input may be provided by the user touching or otherwise making contact with graphic user icons in the display panel. In one example embodiment, the display panel may be disposed along the upper part of imaging apparatus 10 and may be sized for providing graphic images that allow for convenient communication of information between imaging apparatus 10 and the user. In addition or in the alternative, input keys 19 may be provided to receive user input.

With continued reference to FIG. 2, imaging apparatus 10 may define a media path 39 through which media sheets travel, as indicated generally by arrow 41. A plurality of rollers, such as rollers 43, may be disposed within imaging apparatus 10 along media path 39 for guiding a picked media sheet from input media tray 14 through media path 39, moving the picked media sheet to a location adjacent print engine 33 for printing an image thereon and moving the picked media sheet having the printed image to media output area 22. During advancement, the picked media sheet may move from the input media tray 14 to media output area 22 along a substantially L-shaped media path, a C-shaped media feedpath, a straight-through feedpath or other media feedpath configuration known in the art.

Sheet feed system 35 may include a pick arm 49 mounting a pick roller (or pick rollers) 45 which may rest on top of a media sheet 47 of media stack 16. Pick roller 45 may rotate in a direction indicated by arrow 51 to move media sheet 47 into media path 39. In an example embodiment, the pick arm 49 of the sheet feed system 35 may be an auto compensating pick module (ACM) having a drive train (not shown) associated with or encased within pick arm 49 for transmitting both a rotational force and a downward force to pick roller 45. The drive train may include a plurality of gears, pulleys, belts or the like for transferring rotational power from a power source to pick roller 45. The power source may be in the form of a motor (not shown) controlled by controller 30, such as a D.C. motor forming part of the sheet feed system 35, or may be in the form of a separate motor which is coupled to sheet feed system 35 using a clutch (not shown) or the like.

Figure 3:
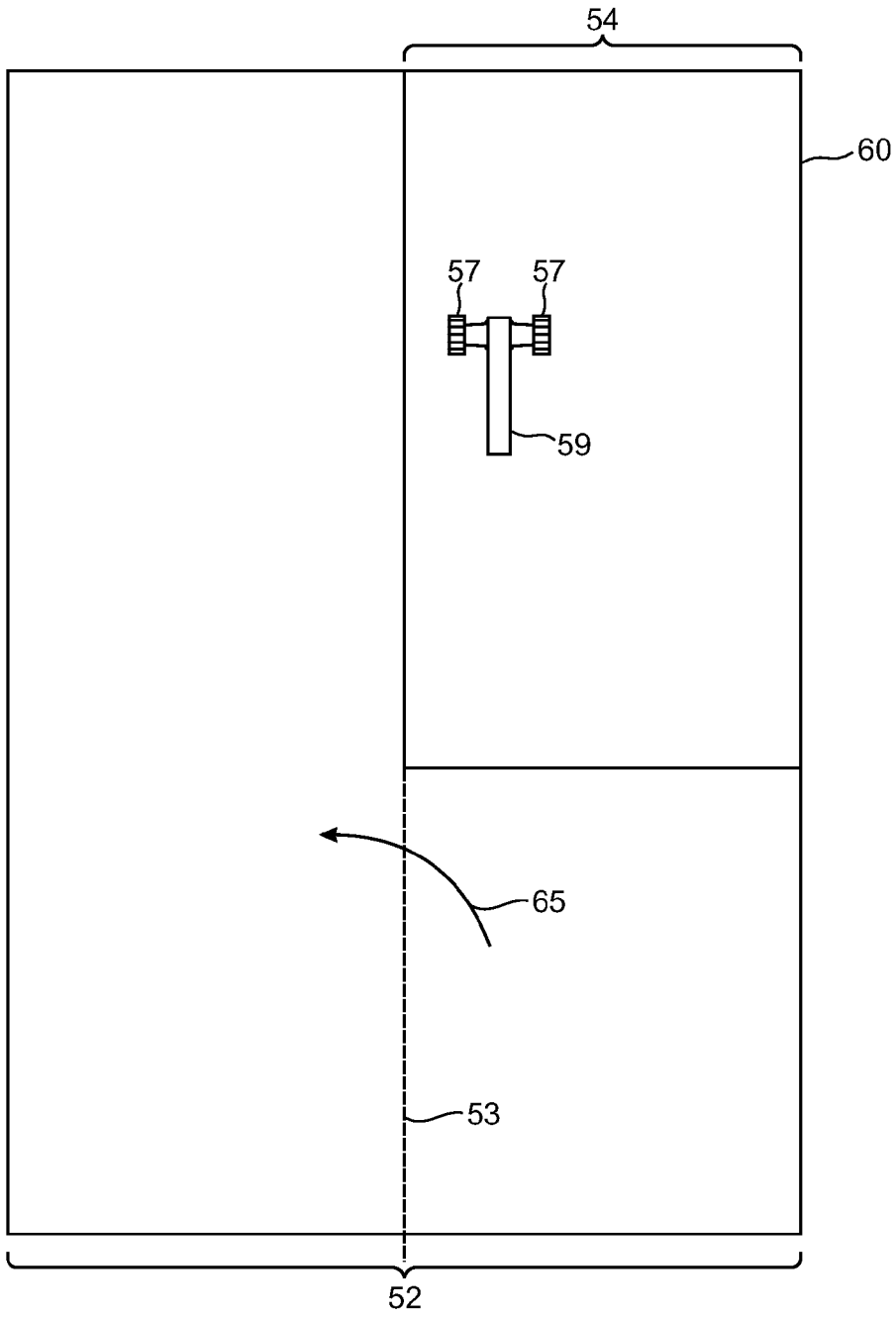
FIG. 3 PRIOR ART
FIG. 3 is an illustrative view of a traditional pick arm position on a media sheet in reference edge type systems.

In traditional reference edge type systems as depicted in FIG. 3, a stack of widest supported media 52 and a stack of narrowest supported media 54 may be positioned within a media tray towards a reference edge 60 thereof. As shown, a pick arm 59 is disposed at a fixed position across the media sheet that is offset from a centerline 53 (represented by a broken line) of the widest supported media 52 such that two pick rollers 57 always contact a topmost sheet for both the stack of widest supported media 52 and the stack of narrowest supported media 54. While this traditional arrangement generally ensures reliable sheet picking operation for both the widest and narrowest supported media, pick reliability of the widest supported media is compromised. When pick forces are applied to the topmost sheet, the offset arrangement of the pick arm 59 creates a moment indicated by arrow 65 onto the top media sheet of the widest supported media 52 that results in skewing the topmost sheet upon feeding into the imaging apparatus, thereby increasing the probability of paper jams. To improve feed reliability in reference edge type systems, media pick forces should remain substantially balanced about the centerline of a media to be picked regardless of media size.

Figure 5:
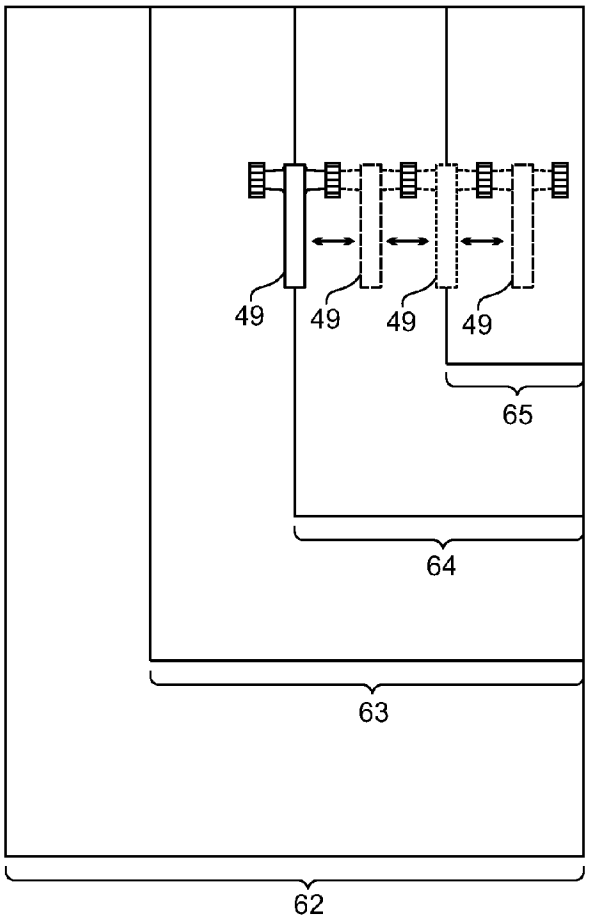
FIG. 5 is an example embodiment illustrating a pick arm that translates between multiple positions.
Figure 4:
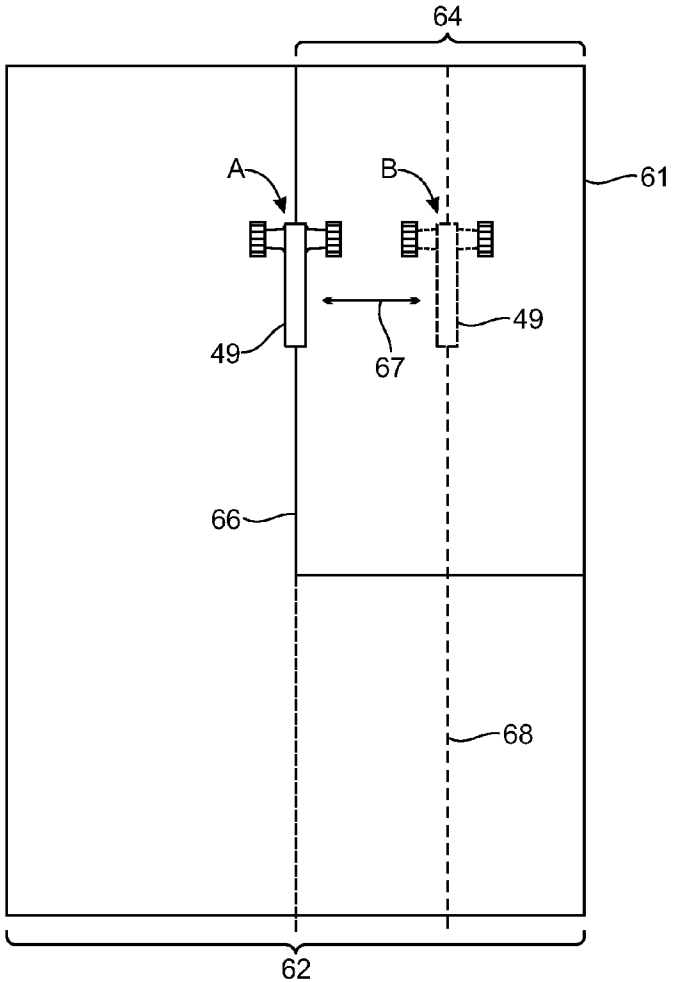
FIG. 4 is an example embodiment illustrating a pick arm that translates between two positions.

In accordance with the present disclosure, FIG. 4 shows pick arm 49 that is movable between two positions A and B. Pick arm 49 may be positioned along centerline 66 of a wide media 62 which may be, for example, A4, Letter, or Legal. If narrow media 64, such as an A5 media, is loaded into media tray 14, pick arm 49 may translate in a direction 67 lateral to the media feed direction towards the reference edge 61 to position B along centerline 68 of the narrow media 64. In an example embodiment, the pick arm 49 may return to a home position every time media tray 14 is removed from the housing 12. In one example embodiment, the home position may be set to a wide media setting such that pick arm 49 substantially aligns with the centerline 66 of wide media 62. Alternatively, the home position may be in a narrow media setting where the pick arm 49 is substantially positioned along centerline 68 of narrow media 64. For ease of description, the home position as used herein is set to the wide media setting although such description should not be considered limiting. It is further contemplated that the pick arm 49 may be movable between a plurality of positions across the media feed direction as shown, for example, in FIG. 5 to accommodate a wide variety of media sizes 62, 63, 64 and 65.

Reference will now be made to FIGS. 6-8 and 11 which show example embodiments of the sheet feed system of the imaging apparatus according to the present disclosure. Sheet feed system 35 may include a pick mechanism 100 having pick arm 49 and pick rollers 45 for picking a topmost media sheet from a stack of media in tray 14, and a pick arm translation mechanism 105 for adjusting the position of the pick arm 49 between two positions laterally and orthogonally across the media sheet stack. In this way, pick arm 49 may be suitably positioned along a centerline of a stack of media sheets so as to provide little if any skewing forces on the top sheet of the stack being picked.

Pick arm 49 is slidably mounted on a shaft 107 which is mounted within the housing 12 of the imaging apparatus 10 across the stack of media sheets. A bracket 109 defines a space for the pick arm 49 to move along the shaft 107. A bracket member 113 mounted on the shaft 107 is connected to an end of the pick arm 49 such that a sliding motion of the bracket member 113 causes the pick arm 49 to slide along the shaft 107 therewith.

The pick arm translation mechanism 105 may include a lever arm 115 disposed above the pick mechanism 100 and pivotably mounted on a frame 119 so as to pivot about a pivot pin 110. The pick arm translation mechanism 105 may further include a lever projection 121 which extends from a surface of the lever arm 115 for initiating movement of lever arm 115 and pick arm 49, as will be discussed in greater detail below. A guide member 123 extending from lever arm 115 is configured to slidably travel along a curved guide slot 125 on the frame 119 so as to define the rotational movement of lever arm 115 about pivot pin 110. A lever spring 131 elastically connects the lever arm 115 to a pin 133 located on a side of the frame 119 so as to support the motion of lever arm 115 and pick arm 49 from their home position for picking wide media (FIG. 6) to a second position for picking narrower media (FIG. 7). The lever arm 115 has an elongated slot 137 formed thereon while the bracket member 113 has a slide pin 139 that passes through the elongated slot 137 for operatively coupling the pick arm 49 to the lever arm 115 such that the slide pin 139 travels along the elongated slot 137 during pivoting of the lever arm 115 about the pivot pin 110. The motion of slide pin 139 of lever arm 115 through elongated slot 137 facilitates linear movement of pick arm 49 along shaft 107.

Figure 6:
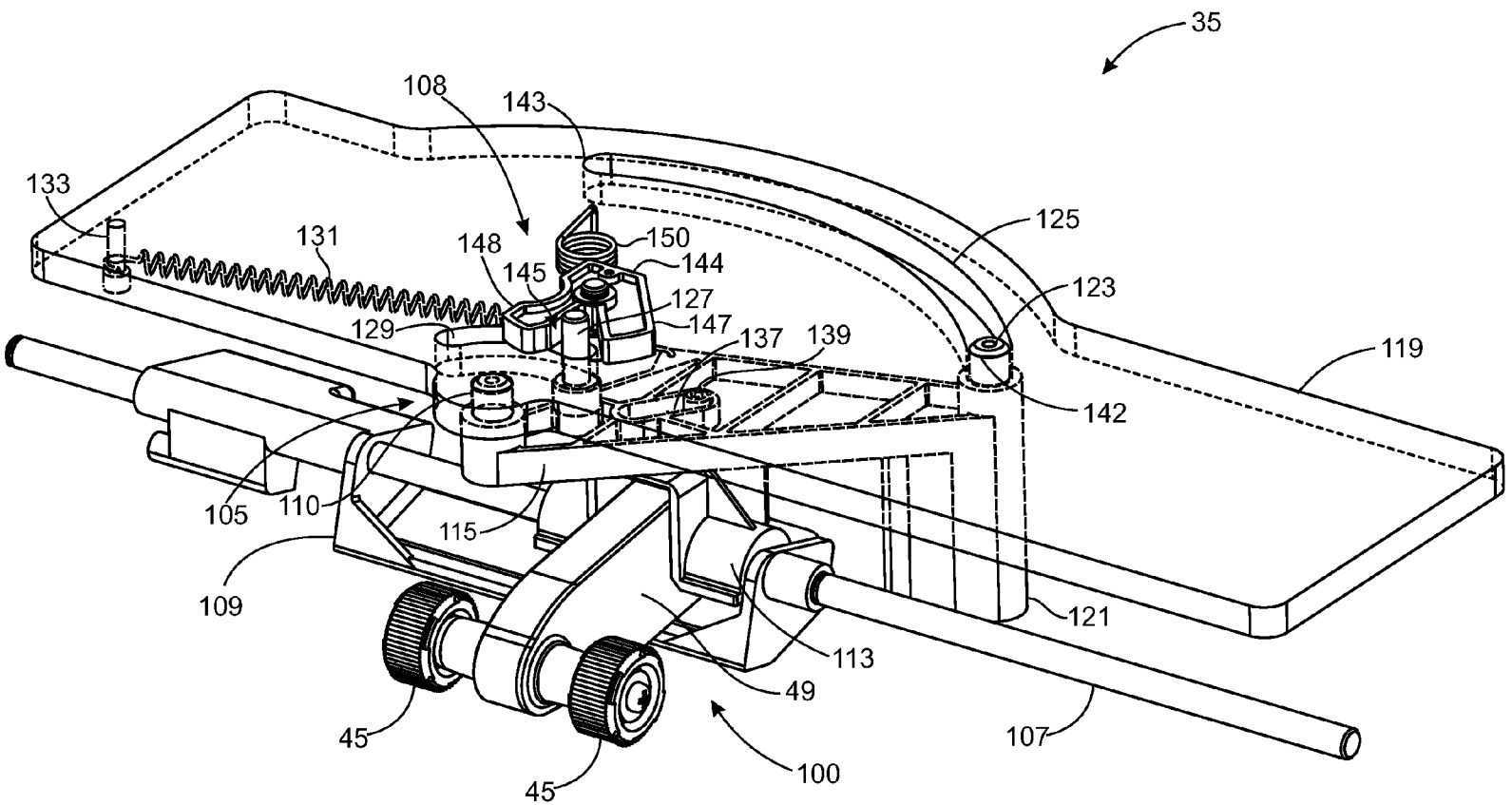
FIG. 6 is a perspective view of a sheet feed system in a wide media mode according to an example embodiment.
Figure 7:
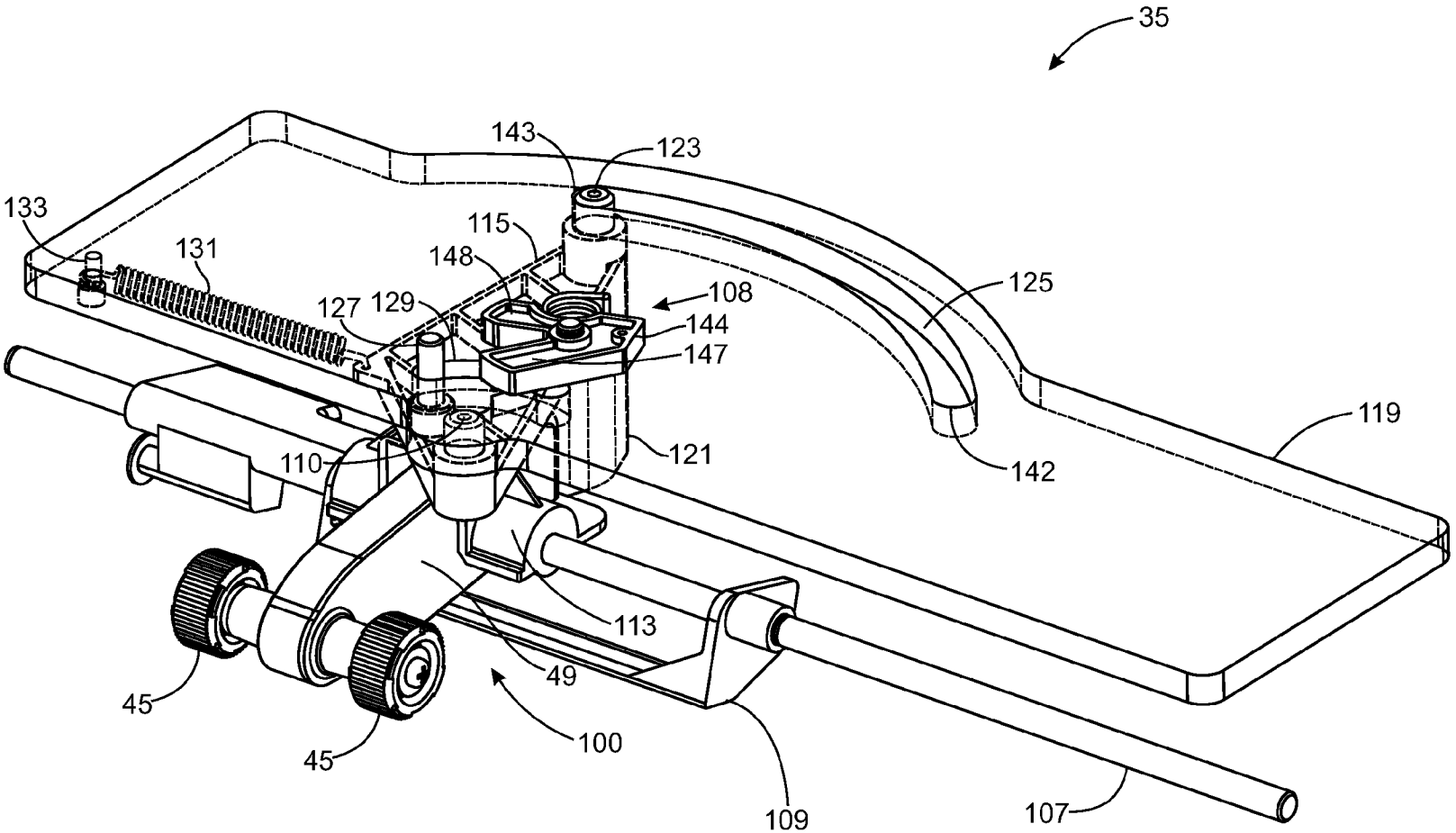
FIG. 7 is a perspective view of the sheet feed system in a narrow media mode according to the example embodiment of FIG. 6.

As shown in FIGS. 6-7, sheet feed system 35 may also include a latch mechanism 108 for latching lever arm 115 and pick arm 49 in the home position for handling wide media. Latch mechanism 108 may include or be operably associated with a lock pin 127 extending upwardly from lever arm 115 through a guide slot 129 defined on frame 119. Latch mechanism 108 may also include a substantially V-shaped member 144 having a first arm or prong 147 and a second arm or prong 148 so as to form a gap 145 that is sized to receive the lock pin 127 when lever arm 115 and pick arm 49 are in the home position (FIG. 6). A lock spring 150 may be coupled to member 144 to provide a biasing force for resisting movement of the lock pin 127 from its position within member 144 corresponding to the home position. The operation of latch mechanism 108 is discussed in greater detail herein below.

Figure 8:
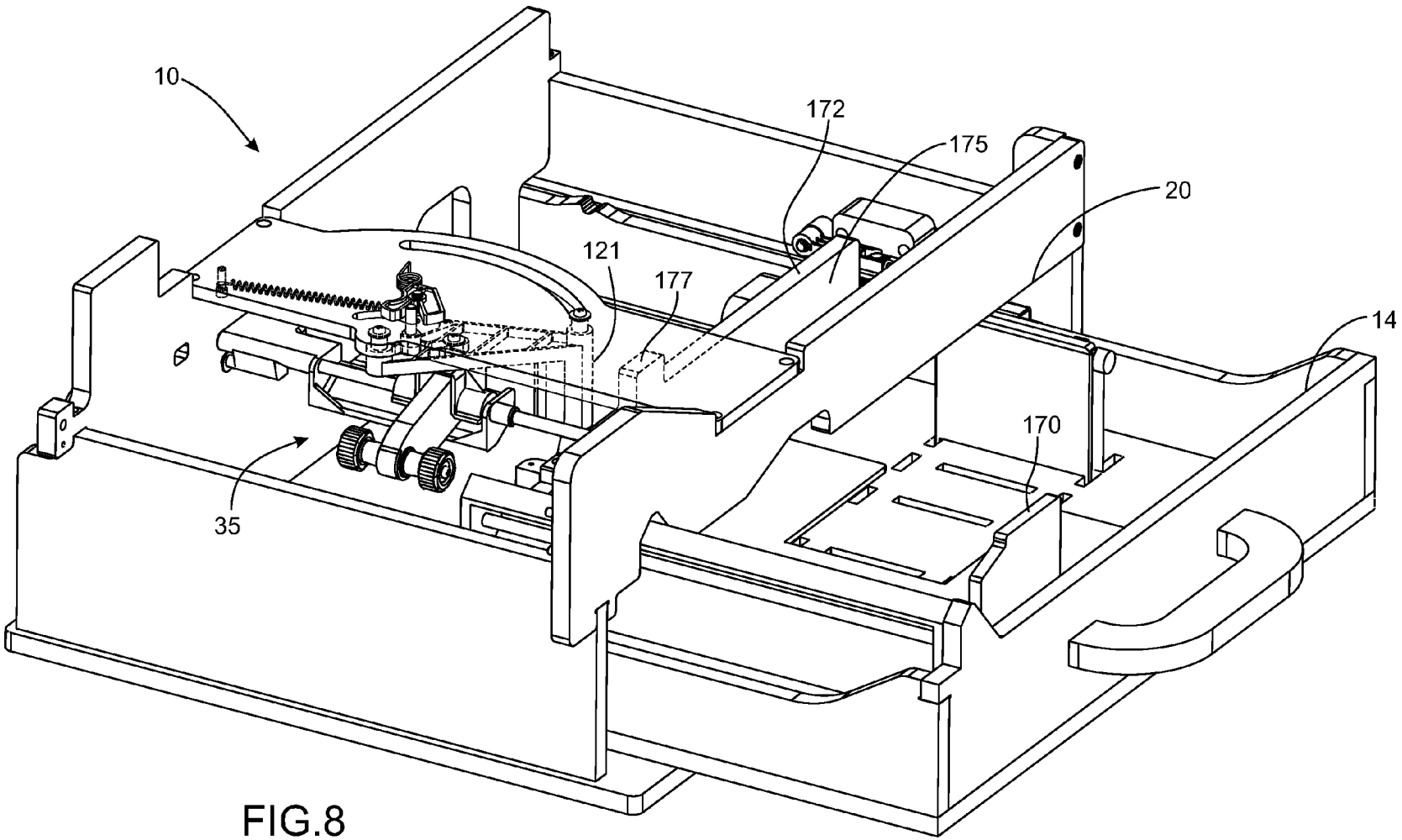
FIG. 8 is a perspective view of the sheet feed system in FIGS. 6 and 7 with a media tray partially removed from the imaging apparatus.
Figure 9:
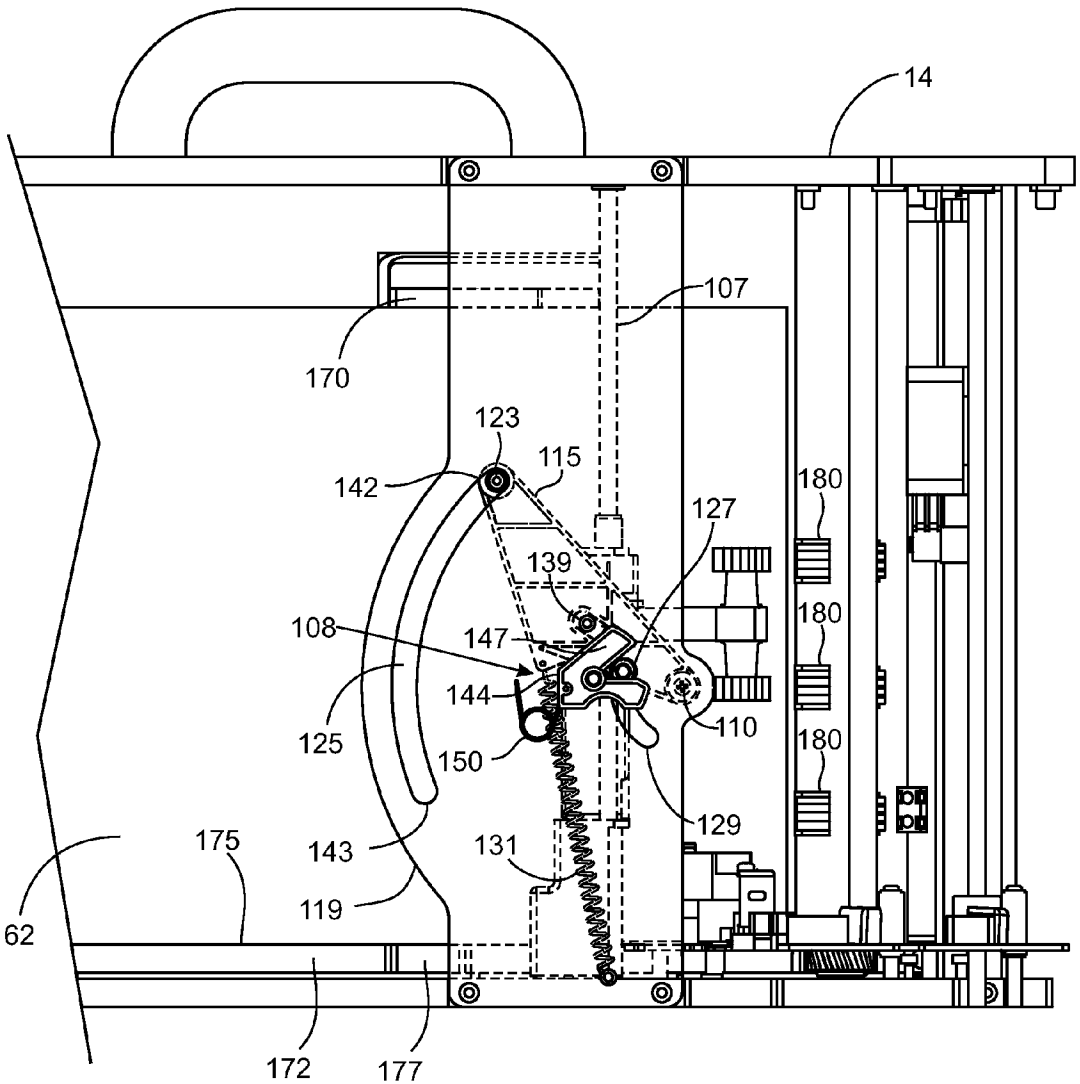
FIG. 9 is a top plan view of FIG. 6.
Figure 10:
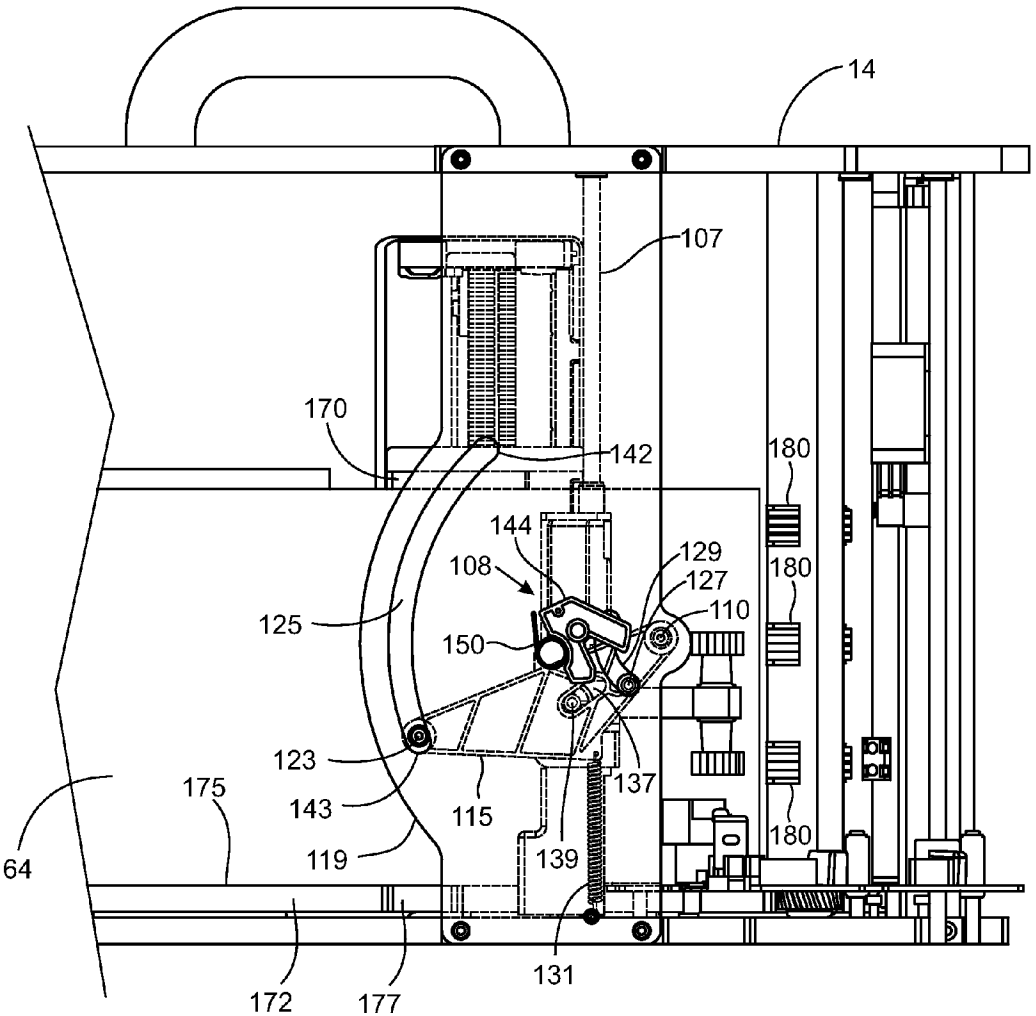
FIG. 10 is a top plan view of FIG. 7.

FIG. 8 is a perspective view showing the sheet feed system 35 with a media tray 14 partially removed from opening 20 of imaging apparatus 10. As shown, the media tray 14 may include a side restraint 170 adjustably positioned therein for biasing a media stack (not shown) towards a reference edge 175 defined by a back wall 172 of the media tray 14 so as to restrain movement of the media stack within tray 14. Media tray 14 may further include a protrusion 177 extending from the back wall 172 opposite the side restraint 170. The side restraint 170 is positioned to directly contact and engage the lever projection 121 during insertion of the media tray 14 into the opening 20 when side restraint 170 is inwardly positioned within tray 14 for supporting narrow media, so as to urge lever arm 115 and pick arm 49 from their home position (supporting wider media as shown in FIGS. 6 and 9) towards the second position for supporting narrower media (as shown in FIGS. 7 and 10). The protrusion 177 is disposed at a location along the back wall 172 to directly contact and engage the lever projection 121 when the media tray 14 is removed from the imaging apparatus 10 (and when lever arm 115 and pick arm 49 are in the second position) so as to urge lever arm 115 and pick arm 49 from the second position (supporting narrower media) towards the home position (supporting wider media).

The operation of the pick arm translation mechanism 105 and latch mechanism 108 according to the present disclosure will now be described in greater detail below with reference to the accompanying drawings.

FIGS. 6 and 9 respectively illustrate perspective and top plan views of the pick arm 49 positioned in a wide media mode for receiving and picking wide media 62. In the wide media mode, the media tray 14 may be loaded with a stack of wide media 62 and inserted into the imaging apparatus 10 as shown in FIG. 9. Prior to tray insertion, the side restraint 170 is adjusted to bias the stack of wide media 62 towards the back wall 172 of the media tray 14. Further, lever arm 115 and pick arm 49 are initially in the home position for picking wide media 62, with lock pin 127 positioned in the gap of member 144 and maintained therein by a biasing force applied by lock spring 150. According to an example embodiment, the stack of wide media 62 may have a width that is greater than, for example, a distance between the back wall 172 and lever projection 121 when lever arm 115 and pick arm 49 are in the home position supporting wide media 62. As shown in FIGS. 6 and 9, with the distance between side restraint 170 and back wall 172 being greater than the distance between back wall 172 and lever projection 121, during tray insertion side restraint 170 does not make contact with lever projection 121 so that lever arm 115 and pick arm 49 are maintained in the home position for picking wide media 62. Following tray insertion, pick arm 49 is controlled to successively pick topmost media sheets from the stack of wide media 62. With pick tires 45 being substantially evenly positioned about centerline 66 of wide media 62, media sheets are picked substantially without skew.

With lever arm 115 and pick arm 49 in the home position (as shown in FIG. 9), protrusion 177 of back wall 172 of tray 14 fails to contact lever projection 121 when tray 114 is later removed from imaging apparatus 10, such as to replenish the stack of media sheets therein. As a result, lever arm 115 and pick arm 49 are maintained in the home position for picking wide media.

When the media tray 14 is loaded with a stack of narrow media 64, the side restraint 170 is adjusted to an inner position within tray 14 so as to contact an edge of the narrow media 64 (FIG. 10). In this case, the distance between side restraint 170 and back wall 172 of tray 14 is less than the distance between back wall 172 and lever projection 121 following tray insertion. As a result, when tray 14 is inserted in imaging apparatus 10, side restraint 170 engages with lever projection 121. Once the force exerted by the side restraint 170 on the lever projection 121 overcomes the biasing force applied to member 144 by the lock spring 150, member 144 rotates and the lock pin 127 disengages from member 144 as the lever arm 115 is pulled by the lever spring 131 to pivot about the pivot pin 110 in a counter-clockwise direction (as viewed from above). Accordingly, as the lever arm 115 undergoes rotational movement, guide member 123 slides along slot 125 until settling at end 143 thereof, and the slide pin 139 moves toward the back wall 172 along elongated slot 137. Movement of slide pin 139 causes bracket member 113, and with it pick arm 49, to move along shaft 107 from one end of bracket 109 to an opposite end thereof. In this second position (FIGS. 7 and 10), pick arm 49 is nominally centered on the topmost sheet of the stack of narrow media 64.

Subsequently, in the event of media exhaustion or media replacement, media tray 14 is removed from the imaging apparatus 10 so as to be loaded with a new stack of media. During tray withdrawal, protrusion 177 in the back wall 172 contacts lever projection 121 and causes projection 121 and lever arm 115 to rotate towards the opening 20 of imaging apparatus 10 about pivot pin 110. As the lever arm 115 undergoes pivotal movement in response to contact with protrusion 177, the slide pin 139 of the bracket member 113 simultaneously moves along a path defined by the shaft 107 in a direction away from the back wall 172 while sliding through the elongated slot 137. Accordingly, the pick arm 49 is slid along the bracket 109 by the bracket member 113 along the shaft 107 from the narrow media mode (FIGS. 7 and 10) to the wide media mode (FIGS. 6 and 9).

The guide member 123 of the lever arm 115 is slid along the curved guide slot 125 while the lock pin 127 extending from the lever arm 115 simultaneously travels along the guide slot 129 in the frame 119. As the guide member 123 approaches the slot end 142, the lock pin 127 is received by member 144 of the latch mechanism 108 which itself rotates upon engagement with lock pin 127. The lock spring 150 is tensioned in response to rotation of member 144 due to the engagement by the lock pin 127. When the guide member 123 reaches the slot end 142 (FIGS. 6 and 9), the lock spring 150 and member 144 are arranged in a position that provides a sufficient amount of bias on the lock pin 127 that overcomes the bias exerted by the lever spring 131 on the lever arm 115, so as to hold the lock pin 127 and the lever arm 115 in place.

With further reference to FIGS. 9 and 10, the sheet feed system 35 may include a plurality of separator rollers 180 arranged downstream of the pick mechanism 100 for receiving a media sheet picked by the pick rollers 45. In an example embodiment, a distance traveled by the pick arm 49 in one pick arm translation along the shaft 107 may be the same as a spacing distance between two adjacent separator rollers 180. In addition or in the alternative, the distance traveled by the pick arm 49 may be substantially equal to a spacing between the pick rollers 45. The configuration enables alignment of the pick rollers 45 and the separator rollers 180 at each distinct position of the pick arm 49 along the shaft 107 and advantageously keeps forces substantially balanced about a picked media sheet.

Figure 11:
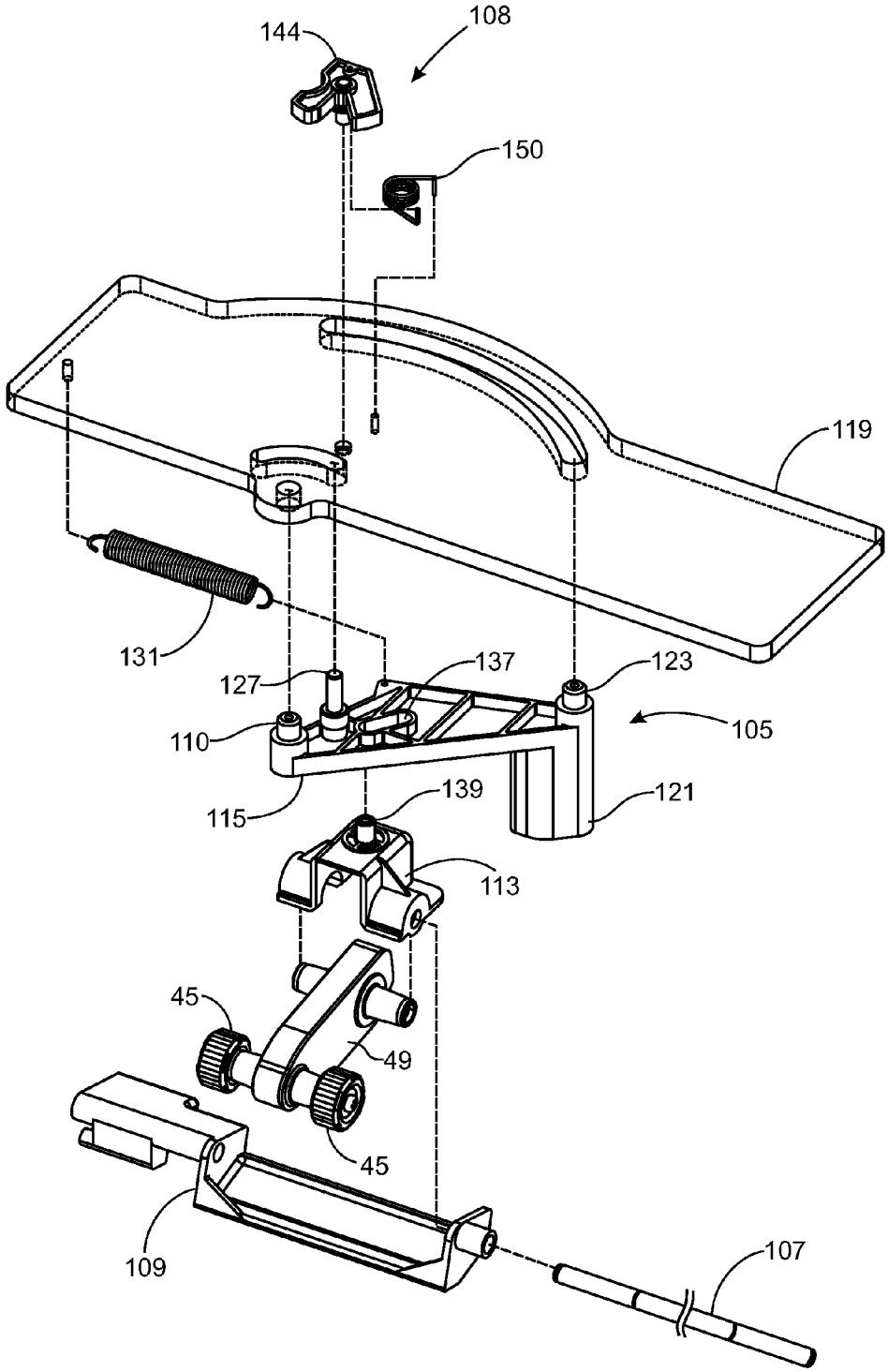
FIG. 11 is an exploded perspective view of the sheet feed assembly of FIGS. 6 and 7.

FIG. 11 is an exploded perspective view of the sheet feed system 35 including the shaft 107, the pick arm 49, the bracket member 113, the pick arm translation mechanism 105, the frame 119, and the latch mechanism 108. As shown, the pick arm 49 is housed at one end opposite the pick rollers 45 by the bracket member 113. Both the pick arm 49 and the bracket member 113 are slidably mounted on the shaft 107. The bracket member 113 is coupled to the pick arm translation mechanism 105 via the slide pin 139 that passes through the elongated slot 137 formed in the lever arm 115. As such, forces acting on the lever arm 115, such as the forces supplied by the lever spring 131, the lock spring 150, or a user removing the media tray 14, create a resultant force that acts on the bracket member 113. The bracket member 113 serves to keep forces associated with a pick arm translation operation from directly acting on the pick arm 49. In particular, the pick arm translation forces are substantially grounded out through the bracket member 113 in both wide media mode and narrow media mode in order to keep the pick arm translation forces from placing a torque on the pick arm 49 during a pick operation and to keep a topmost media sheet from being skewed while being picked.

While the pick arm translation operation has been shown and described as being automatically set during insertion of a media tray, it should be understood that a manual setting by a user may be utilized, such as by manually translating the pick arm along the shaft without activation by inserting and withdrawing input tray 14. Also, although two pick arm positions have been described above, it should be understood that the pick arm translation mechanism may be actuated to cause a movement of the pick arm between more than two positions based on the set position of the side restraint within the media tray and/or other adjustment mechanism. Furthermore, as will be recognized by those skilled in the art, the pick arm translation operations presented herein are applicable to any paper input source such as multi-purpose feeders, automatic document feeders, high capacity input options, or standard paper trays without departing from the scope of the present disclosure.

The foregoing description of several embodiments has been presented for purposes of illustration. It is not intended to be exhaustive or to limit the invention to the precise designs disclosed, and obviously many modifications and variations may be carried out in other specific ways than those herein set forth without departing from the scope and essential characteristics of the invention. It is intended that the scope of the invention be defined by the claims appended hereto.

What is claimed is:

1. A pick device comprising:

a pick arm slidably mounted at a first end thereof on a shaft;

at least one pick roller mounted to a second end of the pick arm for contacting a top of a stack of sheets of media and driven to pick media sheets one at a time therefrom;

a pick arm translation mechanism for moving the pick arm along the shaft such that the at least one pick roller remains substantially evenly positioned about a centerline of a media sheet in a media feed direction; and a bracket member slidably mounted on the shaft and covering at least a portion of the first end of the pick arm such that both the bracket member and the pick arm move together along the shaft, the bracket member operatively coupled to the pick arm translation mechanism and arranged to substantially prevent one or more forces associated with the pick arm translation mechanism from directly acting on the pick arm when the pick arm and the at least one pick roller pick a media sheet from a stack thereof.

2. A pick device comprising:

a pick arm slidably mounted on a shaft;

at least one pick roller mounted to an end of the pick arm for contacting a top of a stack of sheets of media and driven to pick media sheets one at a time therefrom;

a pick arm translation mechanism for moving the pick arm along the shaft such that the at least one pick roller remains substantially evenly positioned about a centerline of a media sheet in a media feed direction; and a frame for supporting the pick arm translation mechanism;

wherein the pick arm translation mechanism includes a lever arm pivotably mounted to the frame about a pivot axis and operatively coupled to the pick arm such that pivotal movement of the lever arm about the pivot axis causes the pick arm to move along the shaft.

3. The device of claim 2, further comprising:

a bracket member attached to the pick arm and slidable along the shaft such that both the bracket member and the pick arm move together along the shaft;

wherein the lever arm has an elongated slot formed in a body thereof and the bracket member has a slide pin coupled to the lever arm by passing through the elongated slot for sliding therein when the lever arm pivots about the pivot axis so that the pick arm moves along the shaft.

4. The device of claim 2, wherein the frame includes a curved guide slot and the lever arm further includes a guide member positioned to slidably travel in the curved guide slot when the lever arm rotates about the pivot axis.

5. The device of claim 2, further comprising a latch mechanism attached to the frame for locking both the lever arm and the pick arm at a first position relative to the frame.

6. The device of claim 5, wherein the pick arm translation mechanism further includes:

a lever spring having opposite ends connected to the lever arm and to a side of the frame;

wherein the frame includes a guide slot and the lever arm further includes a lock pin extending through the guide slot for sliding therein when the lever arm pivots about the pivot axis, the latch mechanism being configured to lock the lever arm and the pick arm at the first position by engaging the lock pin, and the lever spring configured to bias the lever arm towards a second position when the lock pin is disengaged from the latch mechanism.

7. The device of claim 2, wherein the lever arm further includes a lever projection extending from a surface thereof, the lever projection being responsive to user-applied forces to move between a plurality of positions, the movement of the lever projection causing the lever arm to rotate about the pivot axis and the pick arm to move along the shaft to a number of positions, each position of the pick arm corresponding to a distinct position of the lever arm, and each position of the pick arm corresponding to a different media sheet size.

8. A media feed system comprising:

a pick mechanism having a pick arm and a plurality of pick rollers, the pick arm slidably mounted on a shaft, the plurality of pick rollers mounted to an end of the pick arm for contacting a top of a stack of sheets of media and driven to pick media sheets one at a time therefrom;

a pick arm translation mechanism for moving the pick arm between a plurality of positions along the shaft based on media sheet size of the media stack such that the plurality of pick rollers remain substantially evenly positioned about a centerline of a media sheet in a media feed direction;

a frame for supporting the pick arm translation mechanism; and wherein the pick arm translation mechanism includes a lever arm coupled to the pick mechanism and pivotably mounted to the frame about a pivot axis, the pick mechanism configured to move along the shaft when the lever arm undergoes pivotal movement about the pivot axis.

9. The system of claim 8, further comprising:

a bracket member attached to the pick mechanism and slidable along the shaft such that both the bracket member and the pick mechanism move together along the shaft;

wherein the lever arm is operatively coupled to the bracket member.

10. The system of claim 8, wherein the lever arm has an elongated slot formed in a body thereof and the bracket member has a slide pin connected to the lever arm by passing through the elongated slot for sliding therein when the lever arm pivots about the pivot axis such that the pick arm moves along the shaft.

11. The system of claim 8, wherein the frame includes a curved guide slot and the lever arm further includes a guide member positioned to slidably travel in the curved guide slot when the lever arm rotates about the pivot axis.

12. The system of claim 8, further comprising a latch mechanism connected to the frame for locking both the lever arm and the pick arm at a first position relative to the frame.

13. The system of claim 12, wherein the frame includes a guide slot and the lever arm further includes a lock pin extending through the guide slot for sliding therein when the lever arm pivots about the pivot axis; and wherein the latch mechanism is movable between a locked position to engage with the lock pin and lock the pick arm in the first position along the shaft, and an unlocked position disengaged from the lock pin to allow the pick arm to move to a second position along the shaft.

14. The system of claim 13, wherein the latch mechanism includes first and second arms that define an opening that is sized to receive the lock pin, and a lock spring having a first end connected to the frame and a second end connected to the first and second arms, the lock spring imparting a force on the lock pin via the first and second arms when the latch mechanism is in the locked position so as to bias the pick arm in the first position.

15. The system of claim 13, wherein the pick arm translation mechanism further includes a lever spring having opposite ends respectively connected to the lever arm and to a side of the frame, the lever spring urging the lever arm to the second position when the latch mechanism disengages the lock pin.

16. The system of claim 8, further comprising:

a housing in which the frame is disposed, the housing including an opening; and a media tray for holding the media stack and sliding within the opening of the housing;

wherein the media tray includes a media restraint member adjustably mounted therein for restraining movement of the media stack within the tray, and a protruding member extending from a back wall thereof opposite the media restraint member, and the lever arm further includes a lever projection extending from a surface thereof, the lever projection engageable by the media restraint member and the protruding member when the media tray is inserted into and removed from the housing, respectively, such that the pick arm translation mechanism is selectively moved to a first position based upon a position of the media restraint member within the media tray when the media tray is inserted into the housing and selectively moved from first position when the media tray is removed therefrom.

17. The system of claim 8, further comprising a plurality of separator rollers arranged downstream of the pick mechanism to receive media sheets that are picked by the pick rollers, wherein a movement distance between two positions of the pick arm along the shaft is substantially the same as a spacing between two separator rollers such that the pick rollers substantially align with corresponding separator rollers at each distinct position of the pick arm along the shaft.

18. A media feed system comprising:

a housing;

a media tray for holding a media stack, the media tray being insertable within the housing and including a media restraint member adjustable within the media tray for setting media sheet size;

a pick mechanism disposed above the media tray when the media tray is inserted within the housing and having a pick arm and one or more pick rollers, the pick arm slidably mounted on a shaft, the one or more pick rollers mounted to an end of the pick arm, the pick arm movable along the shaft between a first position and a second position;

a pick arm translation mechanism engageable with the media tray for selectively moving the pick arm from the first position to the second position along the shaft during insertion of the media tray within the housing, based on a position of the media restraint member within the media tray.

19. The system of claim 18, further comprising:

a frame for supporting the pick arm translation mechanism;

a bracket member attached to the pick mechanism and slidable along the shaft such that both the bracket member and the pick arm move together along the shaft; and a lever arm operatively coupled to the bracket member and pivotably mounted to the frame about a pivot axis, the lever arm undergoing pivotal movement about the pivot axis concurrently with a movement of the pick mechanism along the shaft such that the lever arm is in a third position when the pick mechanism is in the first position and in a fourth position when the pick mechanism is in the second position.

20. The system of claim 19, further comprising:

a latch mechanism connected to the frame;

a lever spring having opposite ends respectively connected to the lever arm and to a side of the frame;

wherein the frame includes a guide slot and lever arm includes a lock pin extending through the guide slot for sliding therein when the lever arm pivots about the pivot axis; and wherein the latch mechanism is movable between a locked position to engage with the lock pin and lock the pick mechanism in the first position, and an unlocked position disengaged from the lock pin to allow the lever spring to bias the lever arm towards the fourth position and the pick arm towards the second position.

21. A media feed system comprising:

a pick mechanism having a pick arm and a plurality of pick rollers, the pick arm slidably mounted on a shaft, the plurality of pick rollers mounted to an end of the pick arm for contacting a top of a stack of sheets of media and driven to pick media sheets one at a time therefrom;

a pick arm translation mechanism for moving the pick arm between a plurality of positions along the shaft based on media sheet size of the media stack such that the plurality of pick rollers remain substantially evenly positioned about a centerline of a media sheet in a media feed direction; and a plurality of separator rollers arranged downstream of the pick mechanism to receive media sheets that are picked by the pick rollers, wherein a movement distance between two positions of the pick arm along the shaft is substantially the same as a spacing between two separator rollers such that the pick rollers substantially align with corresponding separator rollers at each distinct position of the pick arm along the shaft.

* * * * *